US006656237B1

(12) United States Patent
Barbour et al.

(10) Patent No.: US 6,656,237 B1
(45) Date of Patent: Dec. 2, 2003

(54) FUEL COMPOSITION WITH IMPROVED LUBRICITY PERFORMANCE

(75) Inventors: Robert Howie Barbour, Ashbourne (GB); David John Rickeard, Didcot (GB); Alan Mark Schilowitz, Highland Park, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 25 days.

(21) Appl. No.: 09/856,115

(22) PCT Filed: Sep. 19, 2000

(86) PCT No.: PCT/EP00/09147

§ 371 (c)(1),
(2), (4) Date: Aug. 20, 2001

(87) PCT Pub. No.: WO01/21739

PCT Pub. Date: Mar. 29, 2001

(30) Foreign Application Priority Data

Sep. 20, 1999 (GB) ..... 9922234

(51) Int. Cl.[7] ..... C10L 1/18; C10L 1/22

(52) U.S. Cl. ..... 44/429; 44/333; 44/340; 44/347; 44/349; 44/350; 44/329

(58) Field of Search ..... 44/429, 329, 340, 44/333, 347, 349, 350

(56) References Cited

U.S. PATENT DOCUMENTS 2,864,676 A * 12/1958 Thompson ..... 44/340
4,863,623 A * 9/1989 Nalesnik ..... 508/256

FOREIGN PATENT DOCUMENTS

EP 874039 * 10/1998

* cited by examiner

*Primary Examiner*—Cephia D. Toomer
(74) *Attorney, Agent, or Firm*—Paul E. Purwin

(57) ABSTRACT

This invention provides a fuel composition having a sulphur content of not more than 50 ppm by weight and comprising at least 50 ppm based on the total weight of the fuel composition of at least one fused polycyclic aromatic compound which comprises at least one exocyclic group containing nitrogen wherein the nitrogen is attached directly to a ring carbon atom. Specific examples of such compounds include 1-amino naphthalene, 1,8-diaminonaphthalene, or 5-aminoindole, 2-(2-aminophenyl)indole and 8-aminoquinoline. These compounds are capable of improving the antiwear and lubricity properties of a low sulphur fuel when compared with that of the same fuel in the absence of such compounds.

9 Claims, No Drawings

FUEL COMPOSITION WITH IMPROVED LUBRICITY PERFORMANCE

This invention relates to fuel compositions of low sulphur content which contain at least one component capable of enhancing the lubricity of such low sulphur fuels.

Fuels such as diesel are widely used in automotive transport due to their low cost. However, one of the problems with such fuels is the presence of relatively high concentrations of sulphur containing compounds. Excessive sulphur contributes to exhaust particulate emissions and can also degrade the effectiveness of some exhaust after-treatment technology which is being introduced in response to regulated limits on exhaust emissions. As a result, the permitted level of sulphur in diesel fuel has been progressively reduced over the years and further reductions are planned for the future. Whilst reduction in sulphur content can be readily achieved by well known processes such as eg hydrodesulphurisation which is generally carried out in the presence of a catalyst, such process also adversely affects the lubricity of the resultant desulphurised product. Consequently, it is necessary to formulate compositions which are low in sulphur content but are also of the desired lubricity in order to minimise wear and friction and thus protect against damage to the injection system of a diesel engine. It has hitherto been the practice to add anti-wear agents to such formulations including fatty acid esters, lactones, polyoxyalkylene ethers, amino compounds and the like for this purpose. However, compositions containing compounds such as esters are expensive in terms of both material and storage costs. An article by D. Wei et al in Lubrication Science, 1989, 2(1), pp 63–67 entitled "The Influence of Chemical Structure of Certain Nitrogen-Containing Organic Compounds on Their Antiwear Effectiveness: The Critical Role of Hydroxy Group" discloses that some heterocyclic nitrogen compounds have a beneficial effect on the antiwear performance of base stocks. This author goes on to state that hydroxy groups involved in some nitrogen-containing compounds have been found to improve their antiwear performance significantly and states that hydroxy substituted benzothiazoles are most effective in wear reduction and anti-scuffing. With this in view the author reports the results of the tests carried out on films formed on rubbing surfaces by the benzo-derivatives of pyridine and thiazole, with or without hydroxy groups on the rings. The article concludes that protective films formed on rubbing surfaces by the above heterocyclic compounds bearing a hydroxy group are significantly different from those produced by the analogous compounds without a hydroxyl group.

Recently published EP-A-0885947 discloses the use of various additives to fuel oil compositions which contain no more than 0.05 wt % of sulphur and having a $T_{95}$ of <350° C., the additives being (a) an ashless dispersant comprising an acylated nitrogen compound and (b) a monocarboxylic acid having from 2–50 carbon atoms. There is no mention of fused polycyclic amines or of any fuel containing <50ppm of sulphur. Again, prior published WO 98/16601 claims a fuel oil composition obtainable by the addition of a minor proportion of a compound comprising one or more aromatic ring systems wherein at least one of the ring systems bears as substituents (i) one or more hydrocarbon groups imparting oil solubility to the compound, (ii) one or more hydroxyl groups or derivatives thereof or both, and (iii) one or more amine salt groups. The sulphur concentration of the fuel oil is said to be ≦0.02 wt %. None of the amine salts described, however, are attached directly to a ring carbon atom and no fused polycyclic aromatic amines are disclosed.

The use of compounds such as benzothiazoles will add to the sulphur content of such fuels and consequently derogate from the objective of achieving low Sulphur fuels. Moreover, it has also been found that it is not necessary for the antiwear additive to be a heterocyclic compound. The desired objective can be achieved equally well by using antiwear additives based on polycyclic compounds containing exocyclic nitrogen groups.

The present invention therefore provides a fuel composition having a sulphur content of not more than 50 ppm by weight and comprising at least 50 ppm based on the total weight of the fuel composition of at least one fused polycyclic aromatic compound which comprises at least one exocyclic group containing nitrogen wherein the nitrogen is attached directly to a ring carbon atom.

The sulphur content of the fuel composition is preferably less than 50 ppm by weight and more preferably less than 40 ppm by weight. Such low sulphur levels can be achieved in a number of ways. For instance, this may be achieved by well known methods such as eg, catalytic hydrodesulphurisation. Typically, the present invention is applicable to a broad range of petroleum fuels from light boiling gasoline (boiling range from 120–140° C.). The most common distillate fuels are kerosene, jet fuels, diesel fuels and heating oils. The lubricity properties of ultra-low sulphur (50 ppm or less) base fuels with a $T_{95}$ of suitably 370° C., preferably 360° C., particularly benefit from the presence of the nitrogen compounds referred to above. Especially, the lubricity properties are more of an issue with diesel fuels because diesel fuel injection pumps are more sensitive to wear problems. The base fuels may comprise mixtures of saturated, olefinic and aromatic hydrocarbons and these can be derived from straight run streams, thermally or catalytically cracked hydrocarbon feedstocks, hydrocracked petroleum fractions, catalytically reformed hydrocarbons, or synthetically produced hydrocarbon mixtures. The present invention is particularly applicable to diesel fuels that have recently been introduced into the UK market and are generally referred to as ultra-low sulphur automotive diesel oils (hereafter "ULSADO" and is sampled eg from Esso's Fawley Refinery).

The fused polycyclic aromatic compound which has at least one exocyclic group containing nitrogen wherein the nitrogen is attached directly to a ring carbon atom is capable of acting as an antiwear and lubricity enhancing additive for low sulphur fuels according to the invention. The expression "fused polycyclic aromatic compound" as used herein and throughout the specification is meant that said compound comprises an aromatic moiety which has at least two fused rings of which at least one is an aromatic ring, which aromatic ring may in turn be a heterocyclic ring, whether or not the remaining ring(s) in the fused polycyclic structure are aromatic or carry other hydrocarbyl or functional groups such as alkyl, hydroxyl or ketonic or ester groups. One such example where a cycloaliphatic ring is fused with an aromatic/heterocyclic ring is 1-amino indan and another example is an amino anthraquinone.

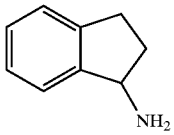

1-Aminoindan

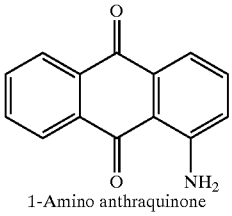

1-Amino anthraquinone

The exocyclic amino group may also be attached directly to a carbon atom of a ring which is itself attached to but is not part of the fused polycyclic ring structure.

Where the fused polycyclic aromatic compound contains a heterocyclic ring, the heteroatom may be nitrogen or oxygen.

The exocyclic group containing nitrogen may be a primary or a secondary amino group and may carry hydrogen and/or hydrocarbyl groups, such hydrocarbyl groups being aliphatic, cycloaliphatic or aromatic in nature and is preferably a primary amino group. In this context, it is worth noting that compounds having two exocyclic nitrogen groups are preferable to compounds which have only one exocyclic nitrogen group. Furthermore, where such compounds have more than one exocyclic nitrogen group, especially primary amino groups, it is even more preferable that these groups are in close proximity and in non-hindered position on the fused polycyclic compound. Thus, it is preferable that the exocyclic nitrogen groups are attached to adjacent carbon atoms, such as eg the 1,2-, 2,3-, 3,4-carbon atoms, or, the 1,8-positions of a binuclear structure of eg the diamino naphthalene type, or, eg the 1,7-positions a diamino indan type. As will be apparent, in the latter two instances, the amino groups are on adjacent carbon atoms if the fused carbon linking the two rings is ignored. Examples of such compounds containing an exocyclic group containing nitrogen wherein the nitrogen is directly attached to a ring carbon atom include inter alia 5-aminoindole, 8-amino quinoline, 1-aminonaphthalene and 1,8-diaminonaphthalene whereas 2-(2-aminophenyl) indole is an example of a compound in which the exocyclic amino group is directly attached to a ring carbon atom wherein the ring itself is attached to a fused polycyclic aromatic compound, ie indole. Where the fused polycyclic aromatic compound contains at least one secondary amino group, it is preferable that the hydrocarbyl substituents on this secondary amino group are aliphatic, more preferably a C1–C4 alkyl group.

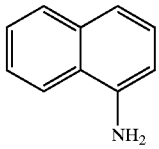

1-Aminonaphthalene

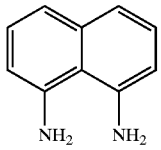

1,8-Diaminonaphthalene

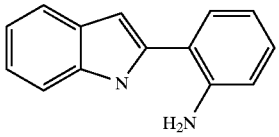

2-(2-Aminophenyl)indole

In this context it is worth noting that the composition according to the present invention has enhanced lubricity when compared with fuel compositions which have a low sulphur content but in which the fused polycyclic aromatic compound containing exocyclic nitrogen group is absent. The amount of the fused polycyclic aromatic compound added to the fuel composition is it least 50 ppm, suitably 70 ppm or more and is preferably from 50–10,000 ppm by weight of the total fuel composition. In this context it will be understood by those skilled in the art that the improvement in antiwear and lubricity characteristics of the fuel composition may not bear a linear relationship commensurate with the amount of the fused polycyclic aromatic compound that is added to said composition. Thus, addition of a vast excess of such an additive may not necessarily continually improve the antiwear or lubricity properties of the fuel composition.

The fuel composition according to the invention may contain one or more conventional fuel additives, which may be added at the refinery, at the fuel distribution terminal, into the tanker, or as bottle additives purchased by the end user for addition into the fuel tank of an individual vehicle. For diesel fuels these additives may include cold flow improvers (also known as middle distillate flow improvers), wax anti-settling additives, diesel fuel stabilizers, antioxidants, cetane improvers, combustion improvers, detergents, demulsifiers, dehazers, lubricity additives, anti-foamants, anti-static additive, conductivity improvers, corrosion inhibitors, drag reducing agents, reodorants, dyes and markers, and the like.

The antiwear and lubricity performance of the fuel compositions of the present invention were measured according to the so-called high frequency reciprocating rig test (hereafter referred to as "HFRR"). The HFRR test consists of a loaded upper ball 6 mm in diameter, which oscillates against a static lower plate. Both friction and contact resistance are monitored throughout the test. The tests are conducted according to the standard procedure published as CEC F-06-A-96 in which a load of 2N (200 g) was applied, the stroke length was 1 mm, the reciprocating frequency was 50 Hz and sample temperature was 60° C. The ambient temperature and humidity were controlled within the specified limits and the calculated value of wear scar diameter was corrected to the standardized water vapour pressure of 1.4 kPa. The specimen ball was a grade 28 (ANSIB3.12), AISI E-52100 steel with a Rockwell harness "C" scale (HRC) number of 58-66 (ISO 6508), and a surface finish of less than 0.05 $\mu$m $R_a$, and the lower plate was AISI E-52000 steel machined from anealed rod, with a Vickers hardness "HV30" scale number of 190-210 (ISO 6507/1). It is turned. lapped and polished to a surface finish of 0.02 $\mu$m $R_a$.

Summary of HFRR test conditions

| | | | |
|---|---|---|---|
| Fluid volume, ml | 2.0 ± 0.20 | Specimen steel | AISI E-52100 |
| Fluid temperature, ° C. | 60 ± 2 | Ball diameter, mm | 6.00 |
| Bath surface area, $cm^2$ | 6.0 ± 1.0 | Surface finish (ball) | <0.05 $\mu$m Ra |
| Stroke length, mm | 1.0 ± 0.02 | Hardness (ball) | 58–66 Rockwell C |
| Frequency, Hz | 50 ± 1 | Surface finish (plate) | <0.02 $\mu$m Ra |
| Applied load, g | 200 ± 1 | Hardness (plate) | 190–210 HV 30 |
| Test duration, minutes | 75 ± 0.1 | Ambient conditions | See text |

The present invention is further illustrated with reference to the following examples. The ULSADOs (50 ppm sulphur) used in this study are described below in Table 1:

TABLE 1

| Analysis | ULSADO |
|---|---|
| Density @ 15° C. | 834.0 |
| Viscosity $KV_{40}$ | 2.52 |
| Sulphur content (ppm) | 27 |
| Nitrogen content (ppm) | 27 |
| Aromatics (% m/m) | |
| 1-ring | 20.55 |
| 2-ring | 7.77 |
| 3-ring | 0.68 |
| Distillation | |
| IBPt | 157 |
| T5% | 181 |
| T10% | 196 |
| T20% | 222 |
| T30% | 246 |
| T40% | 264 |
| T50% | 276 |
| T60% | 286 |
| T70% | 293 |
| T80% | 301 |
| T90% | 310 |
| T95% | 318 |
| FBPt | 331 |

The following compounds shown in Table 2 below were tested at the specified concentrations:

TABLE 2

| No. | Name | Conc (ppm wt/wt) |
|---|---|---|
| 1 | 1-Aminonaphthalene | 5,000 and 500 |
| 2 | 1,8-Diaminonaphthalene | 500 and 250 |
| 3 | Quinoline | 5,000 |

TABLE 3

| No. | Sample | Conc (ppm wt/wt) | Average Friction | Average wear scar (mm) |
|---|---|---|---|---|
| 1* | Base fuel A | N/A | 0.457 | 573 |
| 2 | 1-Aminonaphthalene | 5,000 | 0.262 | 275 |
| 3 | 1-Aminonaphthalene | 500 | 0.398 | 544 |
| 4 | 1,8-Diaminonaphthalene | 500 | 0.271 | 306 |
| 5 | 1,8-Diaminonaphthalene | 250 | 0.277 | 309 |
| 6* | Quinoline | 5,000 | 0.341 | 499 |

*represents a Comparative Test (not according to the invention)

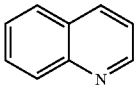

Quinoline

The results presented show that the addition of compounds with an exocyclic nitrogen group improve the lubricity (wear and friction) relative to the base fuel when used alone. Comparison of quinoline and 1-aminonaphthalene shows the improved performance for exocyclic nitrogen compounds versus their heterocyclic analogues. Furthermore it can be seen that the addition of a second exocyclic nitrogen group, in the form of 1,8 diaminonaphthalene, improves the performance further with good activity being maintained down to a treat rate of 250 ppm.

What is claimed is:

1. A fuel composition having a sulphur content of not more than 50 ppm by weight and comprising a major amount of the fuel and a lubricity enhancing additive of at least 50 ppm based on the total weight of the fuel composition of at least one fused polycyclic aromatic compound which comprises at least one exocyclic group containing nitrogen wherein the nitrogen is attached directly to a ring carbon atom, and wherein at least one aromatic ring in the aromatic compound is a heteroclic ring, wherein the heteroatom is nitrogen or oxygen.

2. A fuel composition according to claim 1 wherein the sulphur content of the fuel composition is less than 40 ppm by weight.

3. A fuel composition according to any one of the preceding claims wherein the fuel is a diesel fuel.

4. A fuel composition according to claim 1 wherein the exocyclic group containing nitrogen is a primary or a secondary amino group.

5. A fuel composition according to claim 1 wherein said compound comprises more than one exocyclic nitrogen group and wherein said nitrogen groups are positioned on adjacent carbon atoms.

6. A fuel composition according to claim 1 wherein the fused polycyclic aromatic compound which comprises at least one exocyclic group containing nitrogen is 2-(2-aminophenyl)indole.

7. A fuel composition according to claim 1 wherein the amount of the fused polycyclic aromatic compound which comprises at least one exocyclic group containing nitrogen is added to the fuel composition in an amount of 50–10,000 ppm by weight of the total fuel composition.

8. A fuel composition according to claim 1 wherein the fused polycyclic aromatic compound which comprises at least one exocyclic group containing nitrogen and wherein the nitrogen is attached directly to a ring carbon atom of the polycyclic aromatic compound is capable of acting as an antiwear and/or lubricity enhancing additive for a low sulphur fuel.

9. A fuel composition according to claim 5 wherein the nitrogen atom in the exocyclic nitrogen comprises hydrogen and/or hydrocarbyl groups, preferably selected from aliphatic, cycloaliphiatic and aromatic hydrocarbyl groups.

* * * * *